US010104722B2

(12) United States Patent
Ueki

(10) Patent No.: US 10,104,722 B2
(45) Date of Patent: Oct. 16, 2018

(54) HEAT COOKER

(75) Inventor: Toshiaki Ueki, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 961 days.

(21) Appl. No.: 13/819,679

(22) PCT Filed: Aug. 31, 2011

(86) PCT No.: PCT/JP2011/069710
§ 371 (c)(1),
(2), (4) Date: Feb. 27, 2013

(87) PCT Pub. No.: WO2012/029828
PCT Pub. Date: Mar. 8, 2012

(65) Prior Publication Data

US 2013/0153569 A1 Jun. 20, 2013

(30) Foreign Application Priority Data

Aug. 31, 2010 (JP) ..... 2010-193680

(51) Int. Cl.
*H05B 6/80* (2006.01)
*H05B 6/64* (2006.01)
(Continued)

(52) U.S. Cl.
CPC ..... *H05B 6/642* (2013.01); *F24C 15/006* (2013.01); *F24C 15/08* (2013.01); *F24C 15/322* (2013.01); *H05B 6/804* (2013.01)

(58) Field of Classification Search
CPC ..... H05B 6/804; H05B 6/802; H05B 6/642; F24H 1/101; F24H 1/225; F22B 1/281; F24C 15/006; F24C 15/08; F24C 15/322; F02M 26/21; F02M 26/71; F02M 26/70; F02M 26/53
(Continued)

(56) References Cited

U.S. PATENT DOCUMENTS 3,683,788 A * 8/1972 McDonnell ..... A23B 7/152 99/470
4,340,800 A * 7/1982 Ueda ..... F24C 7/087 219/714
(Continued)

FOREIGN PATENT DOCUMENTS

JP 57-134503 U 8/1982
JP 59-74435 A 4/1984
(Continued)

*Primary Examiner* — Ibrahime A Abraham
*Assistant Examiner* — Gyounghyun Bae
(74) *Attorney, Agent, or Firm* — Birch, Stewart, Kolasch & Birch, LLP

(57) ABSTRACT

The disclosed heat cooker includes a control unit for controlling operation of the variable-type air supply opening. The control unit controls operation of the variable-type air supply opening so that an openness of the air supply opening becomes a predetermined target openness larger than 0% during heat cooking by the heater of the heating object, and upon an end of the heat cooking of the heating object, the control unit further controls operation of the variable-type air supply opening so that the openness of the air supply opening becomes larger than the target openness.

9 Claims, 15 Drawing Sheets

FULLY CLOSED STATE OF AIR SUPPLY OPENING

(51) Int. Cl.
*F24C 15/00* (2006.01)
*F24C 15/08* (2006.01)
*F24C 15/32* (2006.01)

(58) Field of Classification Search
USPC ..... 219/688, 757, 678, 679, 680, 682, 686, 219/687, 698, 702, 703, 707, 710, 719, 219/720, 725–735, 739, 756, 391–414; 126/19 R–34, 35
See application file for complete search history.

(56) References Cited

U.S. PATENT DOCUMENTS 5,078,048 A * 1/1992 Yoshino et al. ..... 99/331
5,272,300 A * 12/1993 Edamura ..... H05B 6/6438 219/506
5,430,272 A * 7/1995 Takahashi ..... H05B 6/666 219/413
5,780,822 A * 7/1998 Lee ..... H05B 6/645 219/710
6,373,039 B2 * 4/2002 Lee ..... H05B 6/6473 126/21 A
6,723,970 B1 * 4/2004 Whipple, Jr. ..... 219/681
6,854,457 B2 * 2/2005 Rabas ..... F24C 15/322 126/20
7,019,272 B2 * 3/2006 Braunisch et al. ..... 219/757
7,297,905 B2 * 11/2007 Kim et al. ..... 219/400
7,304,278 B2 * 12/2007 Kanzaki ..... H05B 6/6479 219/403
8,461,488 B2 * 6/2013 Jeong ..... F24C 15/325 219/399
9,157,640 B2 * 10/2015 Distaso ..... F24C 15/2007
2001/0004077 A1 * 6/2001 Lee et al. ..... 219/757
2001/0032549 A1 * 10/2001 Fukushima ..... A21B 3/04 99/476
2001/0054612 A1 * 12/2001 Kim ..... 219/757
2003/0015514 A1 * 1/2003 Choat et al. ..... 219/400
2003/0084887 A1 * 5/2003 Veinotte ..... F02M 26/21 123/568.18
2004/0118392 A1 * 6/2004 McFadden ..... A21B 1/245 126/21 A
2004/0134908 A1 * 7/2004 Jeong ..... H05B 6/6429 219/757
2005/0121445 A1 * 6/2005 Kang ..... H05B 6/6429 219/757
2005/0236388 A1 * 10/2005 Goranson ..... 219/400
2006/0011607 A1 * 1/2006 Cho et al. ..... 219/401
2006/0191925 A1 * 8/2006 Iwamoto ..... A47B 77/08 219/757
2007/0102426 A1 * 5/2007 Braunisch et al. ..... 219/757
2007/0138160 A1 * 6/2007 Ando ..... A21B 3/04 219/401
2007/0295718 A1 * 12/2007 Takei ..... H05B 6/80 219/756
2008/0149088 A1 * 6/2008 Inada ..... F24C 15/327 126/21 R
2009/0025704 A1 * 1/2009 Padula ..... 126/21 A
2010/0012644 A1 * 1/2010 Phillips ..... F24C 15/325 219/400
2010/0133263 A1 * 6/2010 Toyoda et al. ..... 219/681
2012/0118279 A1 * 5/2012 Asami ..... F24C 15/2007 126/20

FOREIGN PATENT DOCUMENTS

JP 60-138109 U 9/1985
JP 9-72545 A 3/1997
JP 2007-10189 A 1/2007

* cited by examiner

FULLY CLOSED STATE OF
AIR SUPPLY OPENING

FULLY OPENED STATE OF
AIR SUPPLY OPENING

HEAT COOKER

TECHNICAL FIELD

The present invention relates to a heat cooker.

BACKGROUND ART

Among conventional heat cookers is one which includes an exhaust fan for discharging smoke or steam from within a heating compartment out of the heating compartment as described in JP 2007-10189 A (PTL 1). The exhaust fan is not driven during heat cooking of a heating object, which is an item to be heated, but driven when the door of the heating compartment is opened after completion of the heat cooking of the heating object. By the drive of the exhaust fan, smoke or steam in the heating compartment is discharged outside through an exhaust opening positioned apart from the door.

However, in this conventional heat cooker, since the exhaust fan is driven after completion of heat cooking of the heating object, the smoke or steam filled in the heating compartment is blown off at a burst from the exhaust opening.

As a result, there has been an issue that smoke or steam discharged from within the heating compartment after completion of heat cooking of the heating object becomes noticeable.

In such a case, merging an exhaust air stream going out of the heating compartment with other air streams indeed allows the steam to be diluted so as to become less noticeable to some degree, but the smoke is hard to dilute and clearly viewable.

CITATION LIST

Patent Literature

PTL1: JP 2007-10189 A

SUMMARY OF INVENTION

Technical Problem

Accordingly, an object of the present invention is to provide a heat cooker in which smoke discharged from within the heating compartment out of the casing can be made unnoticeable.

Solution to Problem

In order to solve the problem, a cooker according to the present invention comprises:

a casing;

a heating compartment provided in the casing and having an opening on a front face side to accommodate therein a heating object, which is an item to be heated;

a door for opening and closing the opening of the heating compartment;

a heater for heating the heating object;

an air supply fan for sucking outside air outside the casing and blowing the outside air into the casing;

an air supply passage for allowing outside air, which is blown out by the air supply fan, to flow therethrough inside the casing;

a variable-type air supply opening provided in the heating compartment and enabled to bring outside air within the air supply passage into the heating compartment at an arbitrary ratio;

an exhaust opening provided in the heating compartment to discharge smoke within the heating compartment out of the heating compartment;

an exhaust passage for guiding smoke, which has come out of the heating compartment from the exhaust opening, to outside of the casing; and a control unit for controlling operation of the variable-type air supply opening, wherein the control unit controls operation of the variable-type air supply opening so that an openness of the air supply opening becomes a predetermined target openness larger than 0% during heat cooking of the heating object, and upon an end of the heat cooking of the heating object, the control unit further controls operation of the variable-type air supply opening so that the openness of the air supply opening becomes larger than the target openness.

With this constitution, the control unit controls operation of the variable-type air supply opening so that an openness of the air supply opening becomes a predetermined target openness larger than 0% during heat cooking of the heating object, and upon an end of the heat cooking of the heating object, the control unit further controls operation of the variable-type air supply opening so that the openness of the air supply opening becomes larger than the target openness. As a result, during heat cooking of the heating object, a proper degree of air supply into the heating compartment can be fulfilled, so that smoke in the heating compartment can be gradually discharged out of the casing. Thus, during the heat cooking of the heating object, smoke discharged from within the heating compartment out of the casing can be kept unnoticeable.

Further, since discharging of the smoke in the heating compartment is started during the heat cooking of the heating object, filling of smoke in the heating compartment can be prevented at an end of the heat cooking. Therefore, even after an end of the heat cooking, smoke discharged from within the heating compartment out of the casing can be kept unnoticeable.

Then, since the openness of the air supply opening during the heat cooking of the heating object is smaller than the openness of the air supply opening after an end of the heat cooking of the heating object, no large amount of outside air flows through the air supply opening into the heating compartment, so that discharge of high-temperature air in the heating compartment out of the casing is prevented. Thus, temperature declines in the heating compartment can be suppressed, and the time required for heat cooking can be shortened.

In a cooker according to one embodiment, the control unit controls operation of the variable-type air supply opening so that the openness of the air supply opening becomes the target openness at a time point which is a preset time duration before an end of heat cooking of the heating object.

According to this embodiment, the control unit controls operation of the variable-type air supply opening so that the openness of the air supply opening becomes the target openness at a time point which is a preset time duration before an end of heat cooking of the heating object. Thus, until the time point, the openness of the air supply opening may be set to 0% as an example, so that inside of the heating compartment can be maintained at high temperature.

In a heat cooker according to one embodiment, gas blown out into the casing by the air supply fan cools heat generating components in the casing.

According to this embodiment, gas blown out into the casing by the air supply fan cools heat generating components in the casing. Thus, thermal destruction of the heat generating components can be prevented.

In a heat cooker according to one embodiment, gas that has flowed through the air supply passage and that has not flowed into the variable-type air supply opening is finally mixed with exhaust gas discharged from the exhaust opening.

According to this embodiment, gas that has flowed through the air supply passage and that has not flowed into the variable-type air supply opening is finally mixed with exhaust gas discharged from the exhaust opening, and therefore contributes to dilution of the exhaust gas. Thus, the dilution effect for the exhaust gas can be enhanced.

Also, since all of the gas flowing through the air supply passage does not enter into the heating compartment, heat within the heating compartment is prevented from undergoing more than necessary loss.

In heat cookers, generally, it has been a common arrangement that a rear side (a side opposite to the opening side of the heating compartment) of the heat cooker is close to the wall surface. In this case, on condition that exhaust gas in the heating compartment is discharged from the rear side of the heat cooker, there may arise corrosion of the wall surface or occurrence of mold on the wall surface.

Accordingly, In a heat cooker according to one embodiment, the exhaust passage guides smoke, which has come out of the heating compartment from the exhaust opening, toward a front face side of the casing.

According to this embodiment, even if the wall surface is present near the rear face of the casing, the exhaust passage guides the smoke from within the heating compartment toward the front face side of the casing, so that contamination of the wall surface by the smoke can be prevented.

The exhaust passage also guides the steam derived from within the heating compartment toward the front face side of the casing. Thus, there can be prevented corrosion of the wall surface or occurrence of mold on the wall surface.

Accordingly, there is a high degree of freedom for placement of the casing, giving a good convenience for use.

In this connection, in heat cookers other than those of the invention, smoke becomes quite noticeable in cases where smoke is discharged from the front face side of the casing to outside of the casing, more than in cases where smoke is discharged from the rear face side of the casing to outside of the casing.

In contrast to this, in the heat cooker of the invention, the control unit has the medium openness control unit, so that such a problem of smoke's being noticeable can be prevented.

Accordingly, the heat cooker of the invention, in one embodiment, may be so arranged that smoke is discharged from the front surface side of the casing to outside of the casing.

A heat cooker according to one embodiment comprises:

a steam generation unit for generating steam to be supplied into the heating compartment.

According to this embodiment, steam by the steam generation unit is supplied into the heating compartment, so that heat cooking of the heating object can be fulfilled while moisture is being given to the heating object.

In a heat cooker according to one embodiment, the target openness is within a range of 20% to 60%.

According to this embodiment, since the target openness is within a range of 20% to 60%, both a proper degree of air supply into the heating compartment during heat cooking and the prevention of temperature declines in the heating compartment during heat cooking can be satisfied securely at the same time.

Advantageous Effects of Invention

According to the heat cooker of the invention, the control unit controls operation of the variable-type air supply opening so that the openness of the air supply opening becomes a predetermined target openness larger than 0% during heat cooking of a heating object, and further controls operation of the variable-type air supply opening so that the openness of the air supply opening becomes larger than the target openness at an end of the heat cooking of the heating object. Thus, a proper quantity of air supply into the heating compartment is exerted during heat cooking of the heating object, so that the smoke in the heating compartment can be gradually pushed out of the casing. Therefore, during the heat cooking of the heating object, the smoke discharged from within the heating compartment out of the casing can be kept unnoticeable.

Further, since discharging of the smoke in the heating compartment is started during the heat cooking of the heating object, filling of smoke in the heating compartment can be prevented at an end of the heat cooking. Therefore, even after an end of the heat cooking, smoke discharged from within the heating compartment out of the casing can be kept unnoticeable.

Then, since the openness of the air supply opening during the heat cooking of the heating object is smaller than the openness of the air supply opening after an end of the heat cooking of the heating object, no large amount of outside air flows through the air supply opening into the heating compartment, so that discharge of high-temperature air in the heating compartment out of the casing is prevented. Thus, temperature declines in the heating compartment can be suppressed, and the time required for heat cooking can be shortened.

DESCRIPTION OF EMBODIMENTS

Hereinbelow, a heat cooker of the present invention will be described in detail by embodiments thereof illustrated in the accompanying drawings.

Figure 1:
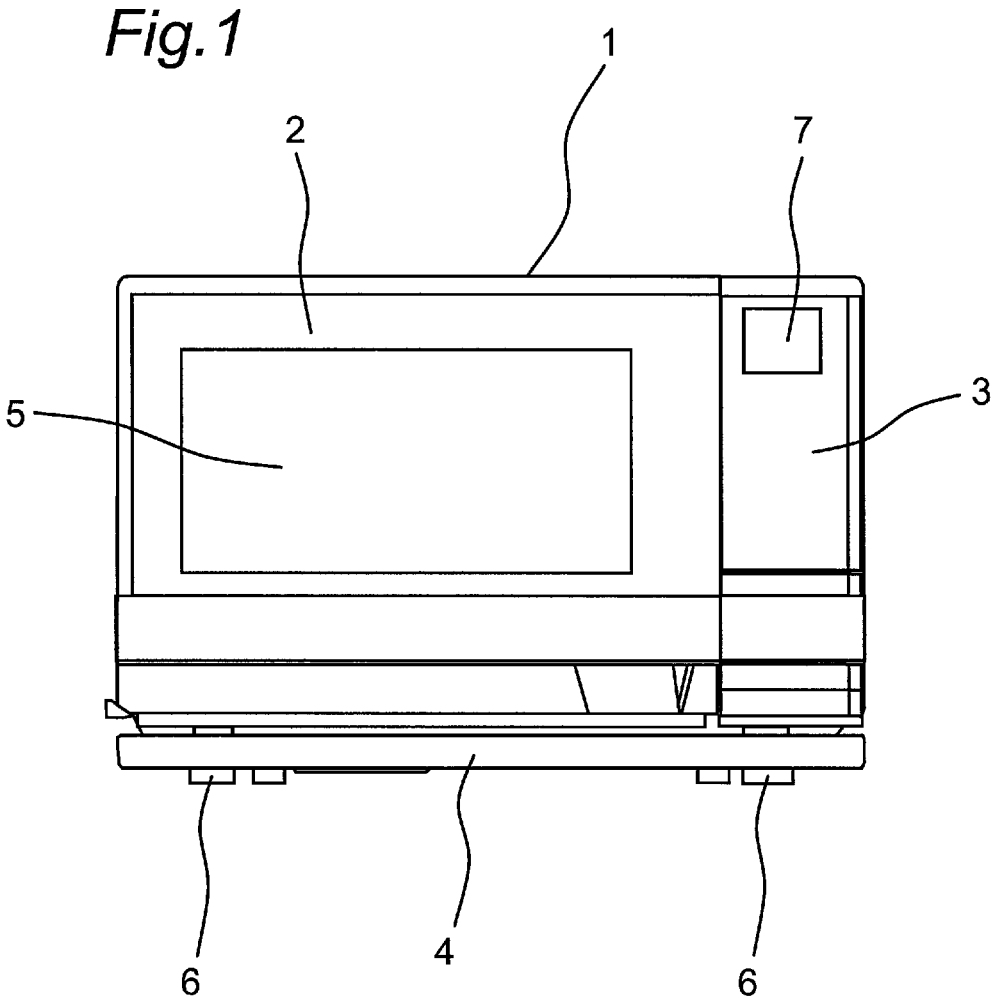
FIG. 1 is a front view of a heat cooker according to an embodiment of the present invention.

FIG. 1 is a front view of a heat cooker according to an embodiment of the invention.

The heat cooker includes a casing 1, and a handle-attached door 2 as an example of a door fitted on a front face side of the casing 1. A heat-resistant glass 5 is set at a generally center of the handle-attached door 2. An operation panel 3 is also provided on the front face side of the casing 1 so as to be adjacent to the closed handle-attached door 2. A dew receiving container 4 is placed below the handle-attached door 2 and the operation panel 3.

The operation panel 3 has an LCD (Liquid Crystal Display) part 7, and the LCD part 7 gives a display corresponding to each operation. Although not shown, a plurality of press buttons and the like are also provided on the operation panel 3.

The dew receiving container 4 is a container that can be fitted to and removed from two front legs 6, 6 provided on the front side of a bottom portion of the casing 1. Then, as the dew receiving container 4 is inserted to below the casing 1 from forward to rearward so as to be fitted to the front legs 6, 6, part of the dew receiving container 4 is positioned below the rear face (back face) of the closed handle-attached door 2. As a result of this, when the handle-attached door 2 is opened, condensed water sticking to the rear face of the handle-attached door 2 is caused to drip into the dew receiving container 4.

Figure 2:
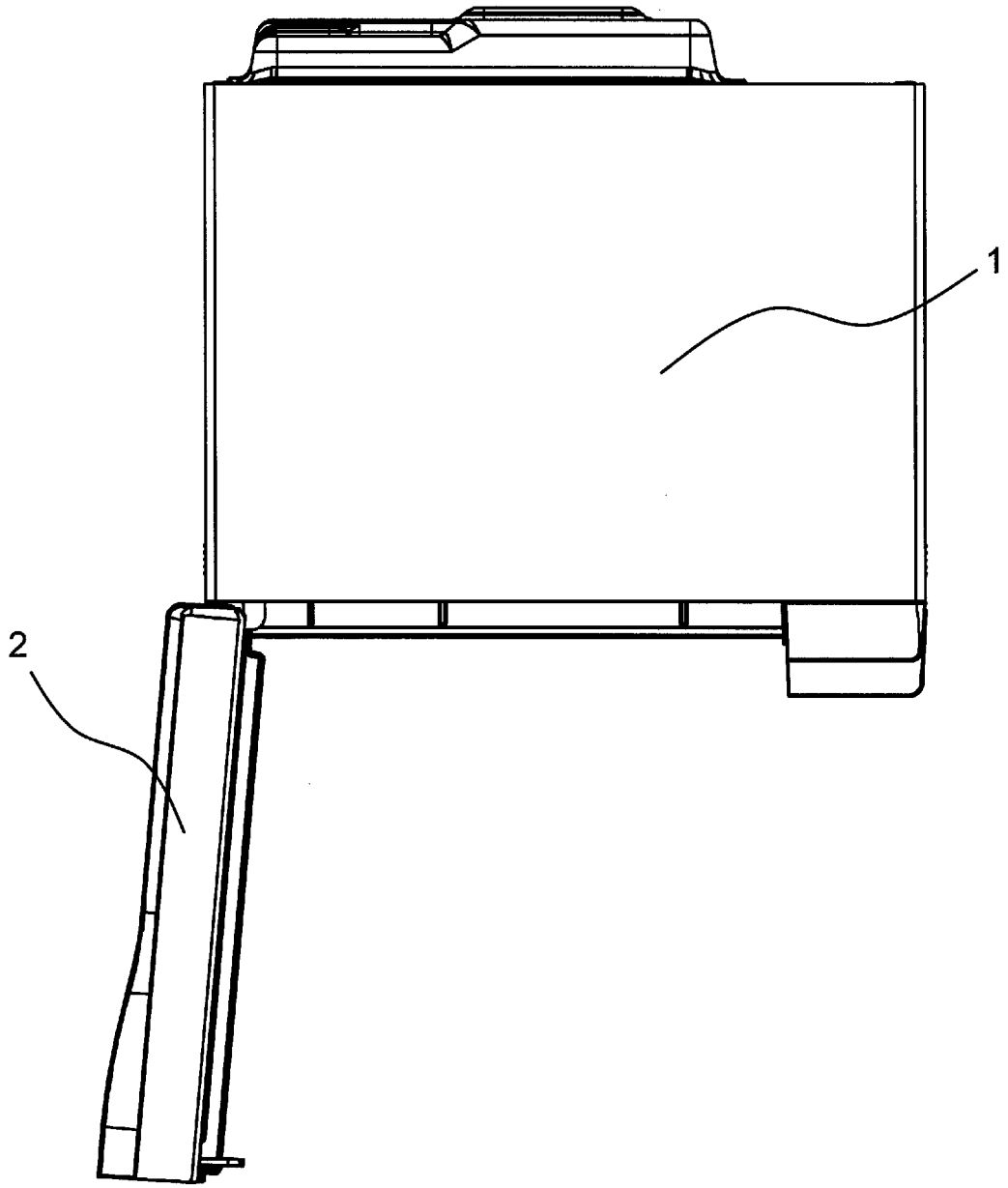
FIG. 2 is a top view of the heat cooker with its handle-attached door opened.
Figure 3:
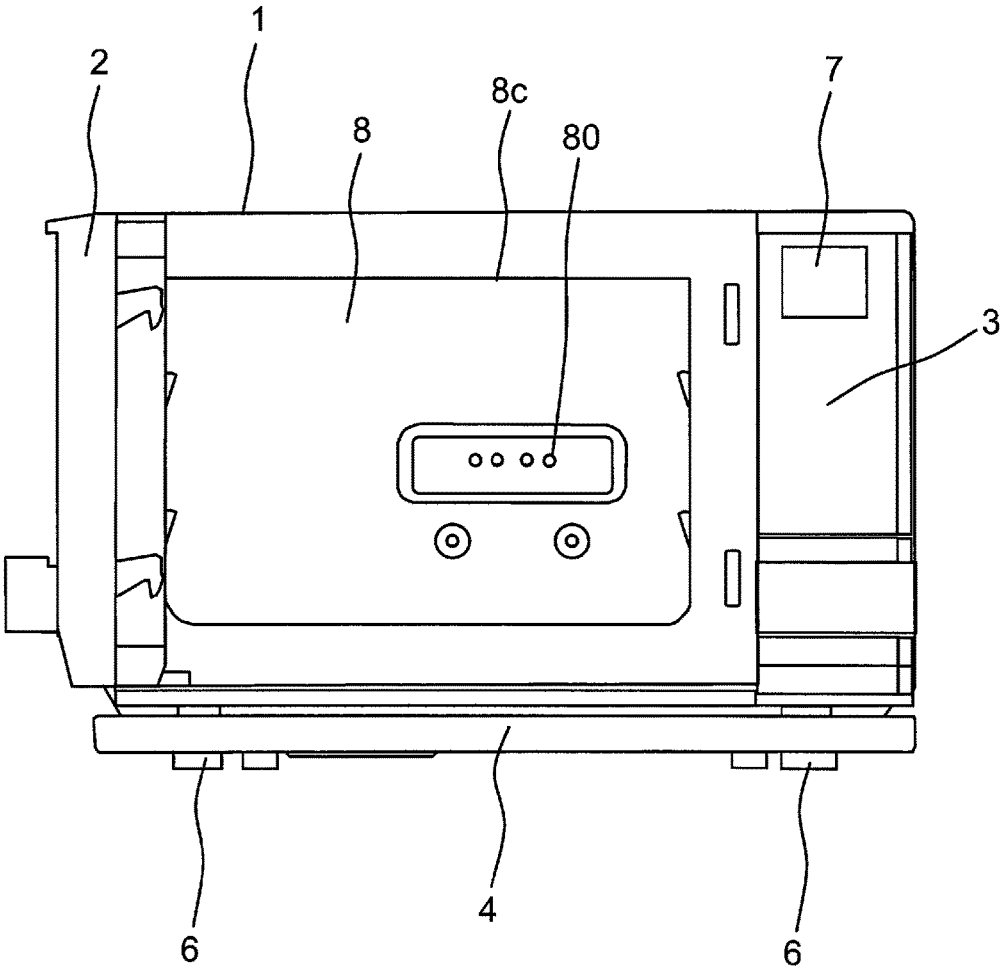
FIG. 3 is a front view of the heat cooker with its handle-attached door opened.

FIG. 2 is a top view of the heat cooker with the handle-attached door 2 opened, as viewed from upward. FIG. 3 is a front view of the heat cooker with the handle-attached door 2 opened, as viewed from the front.

Within the casing 1 shown in FIGS. 2 and 3, a heating compartment 8 for heating a heating object 23 (see FIG. 4), which is an item to be heated, is provided. The heating compartment 8 has an opening 8*c* on the front face side, and the opening 8*c* is opened and closed by left-and-right turns of the handle-attached door 2. In this case, the handle-attached door 2 turns about a left-hand side end portion of the casing 1.

In FIG. 3, reference sign 80 denotes a steam blowoff opening through which steam generated by a steam generation unit 13 (see FIG. 5) blows off toward inside of the heating compartment 8.

Figure 4:
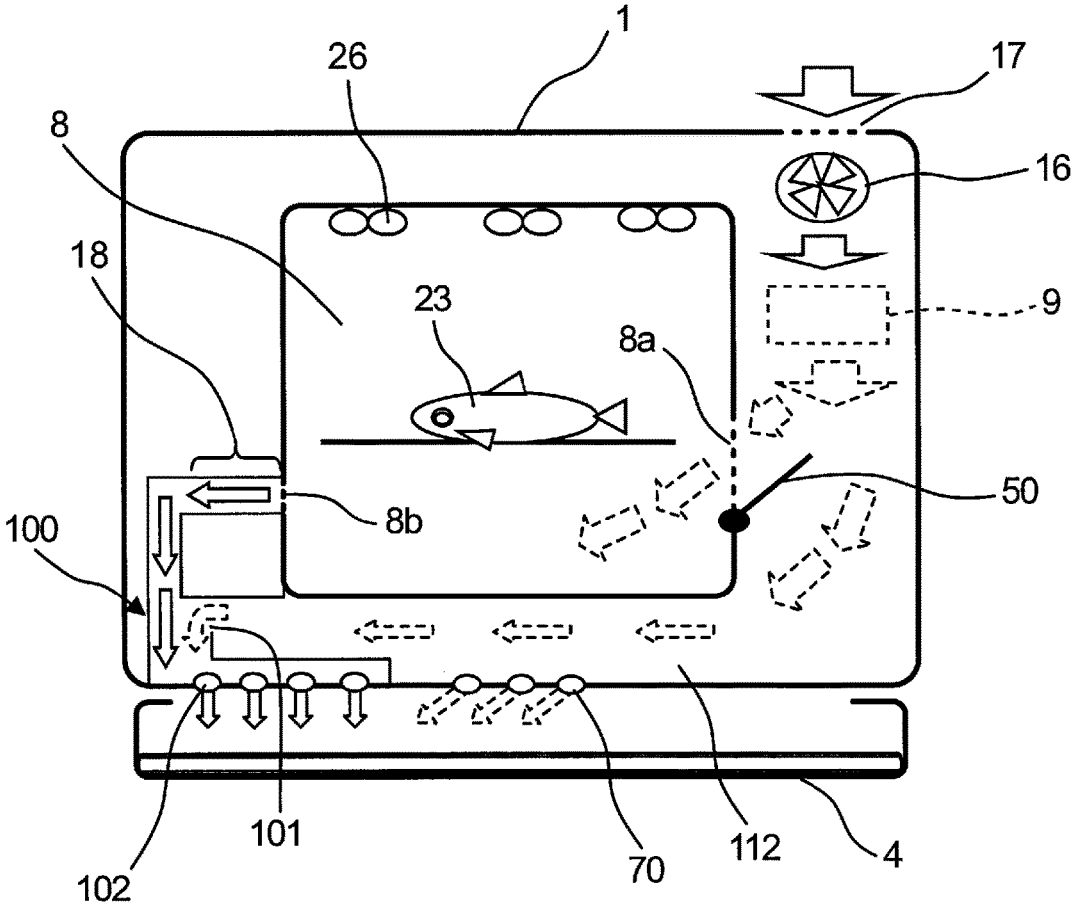
FIG. 4 is a schematic sectional view of the heat cooker.

FIG. 4 is a schematic sectional view of the heat cooker.

In this heat cooker, air outside the casing 1 is sucked into the casing 1 via a plurality of air suction openings 17 by a cooling fan 16 as an example of the air supply fan. Part of the air sucked into the casing 1 via the plurality of air suction openings 17 passes through an electrical component chamber 9 as an example of an air supply passage, and thereafter flows into the heating compartment 8 through a plurality of air supply openings 8*a*, which have been opened by opening operation of an air supply damper 50. Meanwhile, out of the air sucked into the casing 1 via the plurality of air suction openings 17, air other than the air that has flowed into the heating compartment 8 via the plurality of air supply openings 8*a* passes through the electrical component chamber 9 and thereafter flows to the bottom side of the casing 1 so as to go into a cooling air inlet 101 of an exhaust duct 100 via an air passage 112 defined below the heating compartment 8.

Also, part of the air within the heating compartment 8 is discharged to the exhaust duct 100 via an exhaust opening 8*b* and an exhaust tube 18 as an example of an exhaust passage so that the part of air, in the exhaust duct 100, is mixed and diluted with the air that has flowed in through the cooling air inlet 101. The air diluted in the exhaust duct 100 is blown off from a plurality of discharge openings 102 provided in the exhaust duct 100 toward inside of the left-side end portion (an end portion closer to the turning axis of the handle-attached door 2) of the dew receiving container 4.

In this case, part of the air flowing through the air passage 112 is blown off from a plurality of cooling-air blowoff openings 70 provided on the front side of the bottom plate of the casing 1 toward inside of the left-hand side end portion of the dew receiving container 4.

In FIG. 4, reference sign 26 denotes a heater Also, the air suction openings 17 are provided by a plurality of slits formed in a rear portion of the casing 1.

Figure 5:
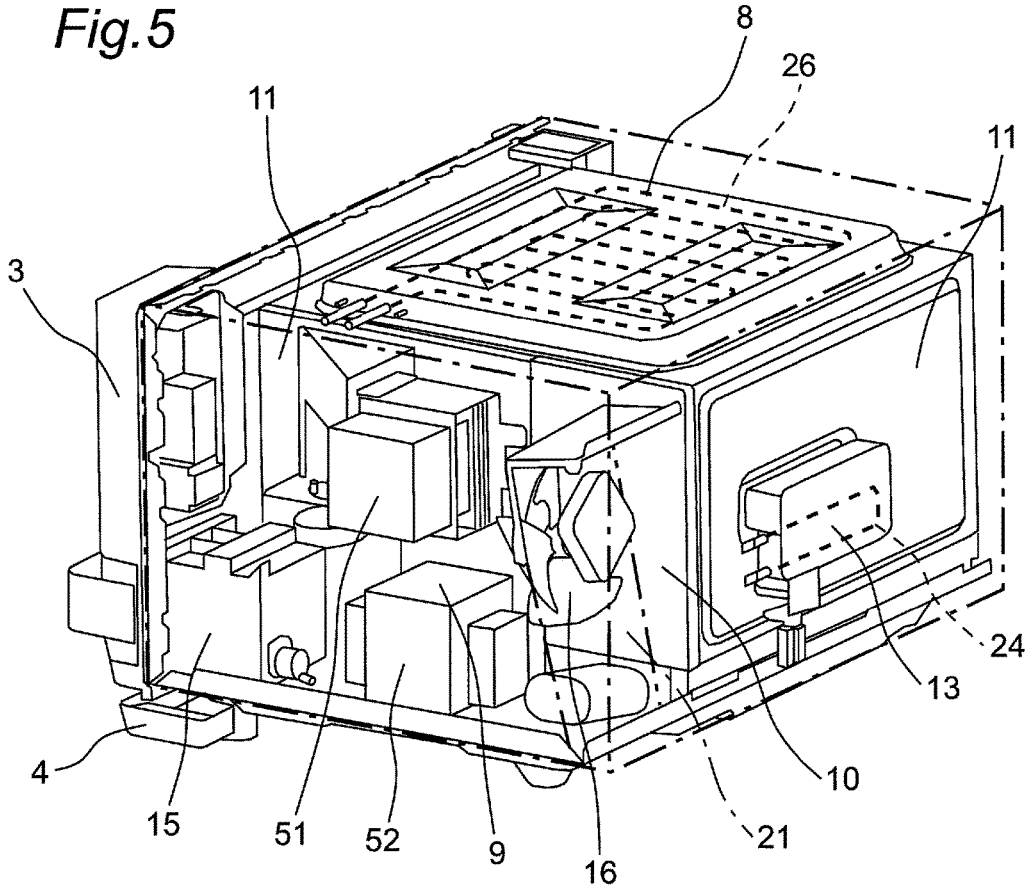
FIG. 5 is a perspective view of the heat cooker with its casing removed.

FIG. 5 is a perspective view of the heat cooker with its casing 1 removed, as viewed from rearward and diagonal upward.

Within the casing 1, an electrical component chamber 9 is provided beside the heating compartment 8 and rearward of the operation panel 3, and an air suction space is provided beside the heating compartment 8 and rearward of the electrical component chamber 9.

In an upper space within the heating compartment 8, a heater 26 for heating the heating object 23 is placed.

On the other hand, outside the heating compartment 8, heat shielding plates 11, 11, are placed in upper, lower, rear and both side portions of the heating compartment 8, respectively. That is, the heat shielding plates 11, 11, are placed on peripheries of the heating compartment 8 except its opening 8*c*. Also, a heat insulating material (not shown) is filled in spaces between the heat shielding plates 11 and the heating compartment 8. It is noted that in FIG. 5, the upper heat shielding plate of the heating compartment 8 is not shown in the figure.

A steam generation unit 13 for generating steam to be supplied to the heating compartment 8 is placed on the rear face side of the heating compartment 8. Also, a water supply pump 35 (see FIG. 6) connected to the steam generation unit 13 via a water supply tube is placed on the lower side of the heating compartment 8.

In the electrical component chamber 9, a tank accommodating part 15 for accommodating a supply water tank (not shown), a magnetron 51, a power transformer 52 and the like are placed. Then, during the heating of the heating object 23, cooling wind from the cooling fan 16 flows in the electrical component chamber 9 so that electrical components such as the magnetron 51 can be cooled. It is noted that electrical components such as the magnetron 51 and the power transformer 52 are an example of heat generating components.

Microwaves generated by the magnetron 51 are led to a lower center of the heating compartment 8 via a waveguide (not shown), and while being agitated by a rotating antenna (not shown), radiated upward in the heating compartment 8 to heat the heating object 23.

Water within the supply water tank accommodated in the accommodating part 15 is supplied to the steam generation unit 13 via a water supply tube (not shown) by the water supply pump 35. In the steam generation unit 13, water from the water supply pump 35 is heated by the steam generation heater 24 to generate steam.

As the cooling fan 16 is driven, air outside the casing 1 flows into the air suction space 10 through the plurality of air suction openings 17 (see FIG. 4). Then, air within the air suction space 10 is fed into the electrical component chamber 9 by the cooling fan 16.

In addition, in FIG. 5, reference sign 21 denotes a partitioning wall for partitioning the electrical component chamber 9 and the air suction space 10 from each other. The cooling fan 16 is attached to this partitioning wall 21.

Figure 6:
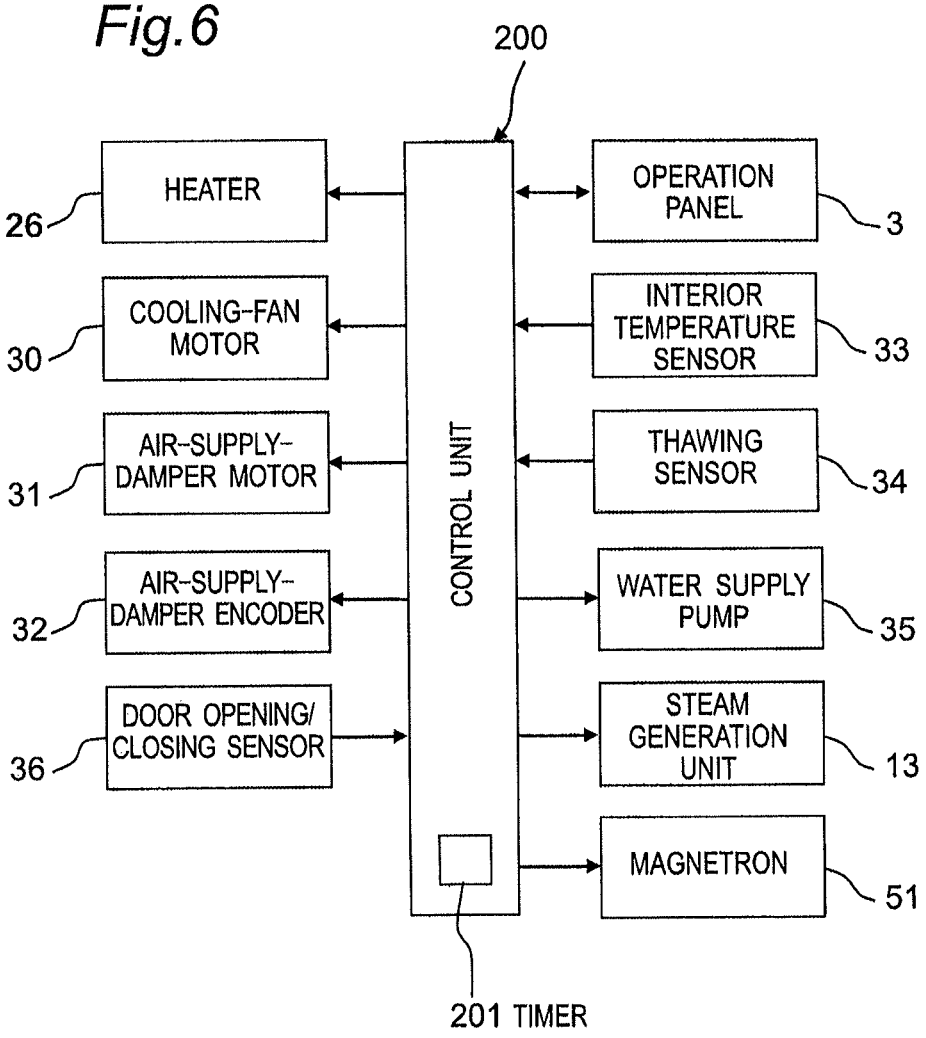
FIG. 6 is a control block diagram of the heat cooker.

FIG. 6 is a control block diagram of the heat cooker.

The heat cooker includes, in the electrical component chamber 9 (see FIGS. 4 and 5), a control unit 200 made up of a microcomputer, input/output circuits and the like. Connected to the control unit 200 are the heater 26, a cooling-fan motor 30, an air-supply-damper motor 31, an air-supply-damper encoder 32, the operation panel 3, an interior temperature sensor 33, a thawing sensor 34, the water supply pump 35, a door opening/closing sensor 36, the steam generation unit 13, and the magnetron 51. Based on a signal from the operation panel 3 as well as detection signals from the air-supply-damper encoder 32, the interior temperature sensor 33, the thawing sensor 34 and the door opening/closing sensor 36, the control unit 200 controls the heater 26, the cooling-fan motor 30, the air-supply-damper motor 31, the operation panel 3, the water supply pump 35, the steam generation unit 13, the magnetron 51 and the like. The control unit 200 further includes a timer 201 for performing measurement of elapsed time or the like.

The door opening/closing sensor 36, which is a sensor for detecting an opening/closing state of the handle-attached door 2, outputs a detection signal corresponding to an opening/closing of the handle-attached door 2 to the control unit 200.

FIGS. 7 to 11 are schematic views for explaining opening/closing operations of the air supply damper 50. Although the air supply openings 8*a* are provided actually in plurality, yet the plurality of air supply openings 8*a* are regarded as one through hole and depicted as such in FIGS. 7 to 11 for an easier understanding of explanation. Accordingly, an opening area of the air supply opening 8*a* in FIGS. 7 to 11 corresponds to a total of opening areas of the actual plurality of air supply openings 8*a*.

Figure 7:
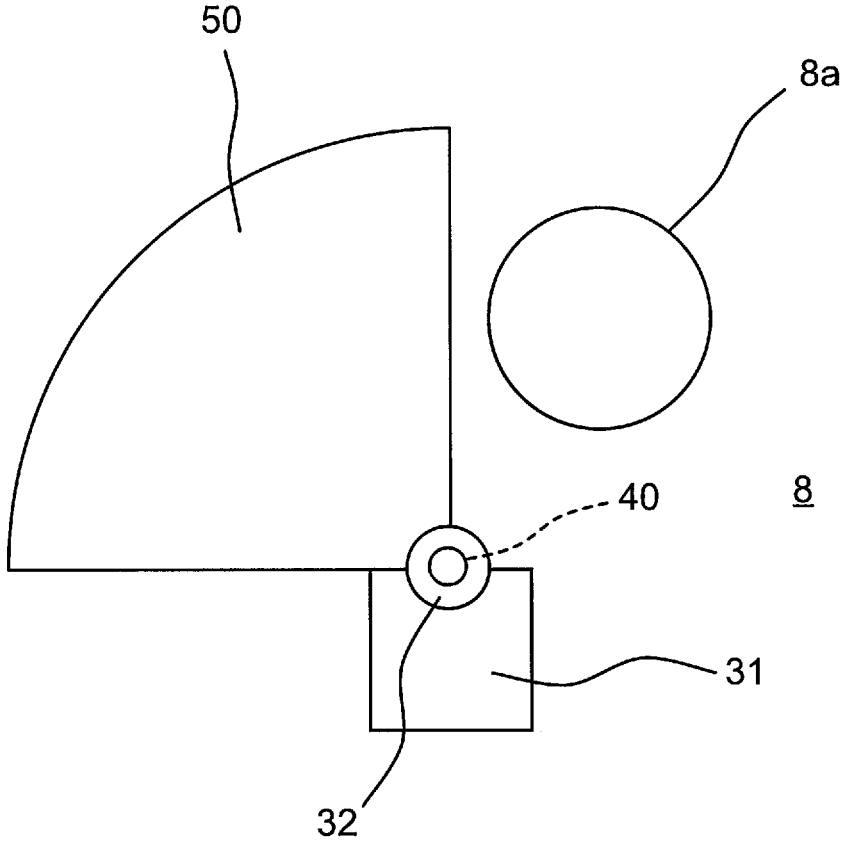
FIG. 7 is a schematic view for explaining opening/closing operations of the air supply damper of the heat cooker.
Figure 8:
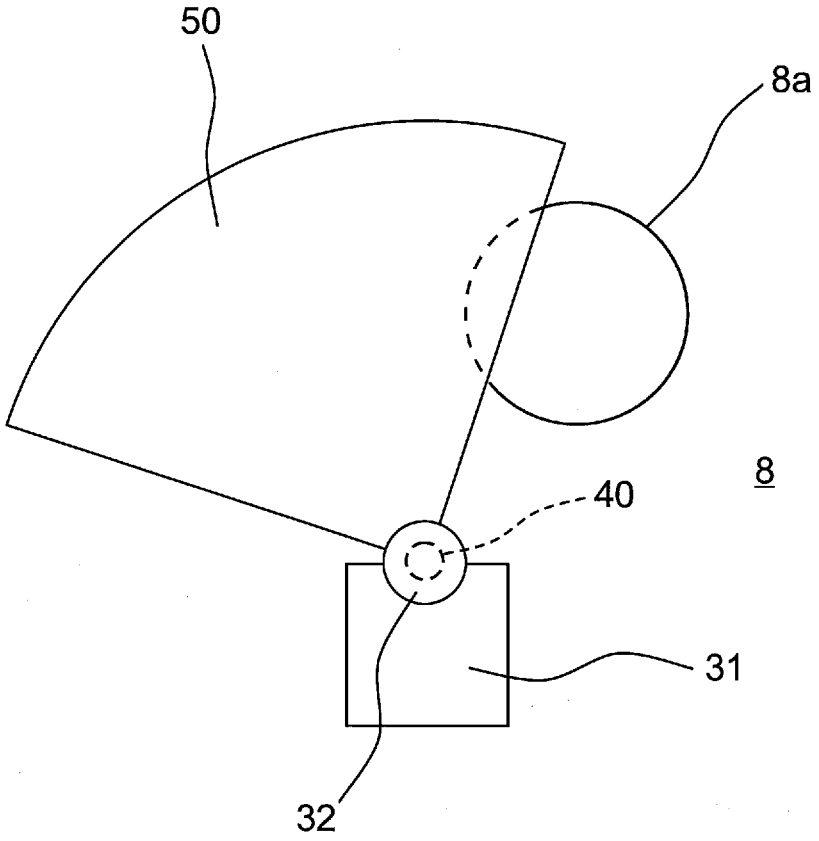
FIG. 8 is a schematic view for explaining opening/closing operations of the air supply damper of the heat cooker.
Figure 9:
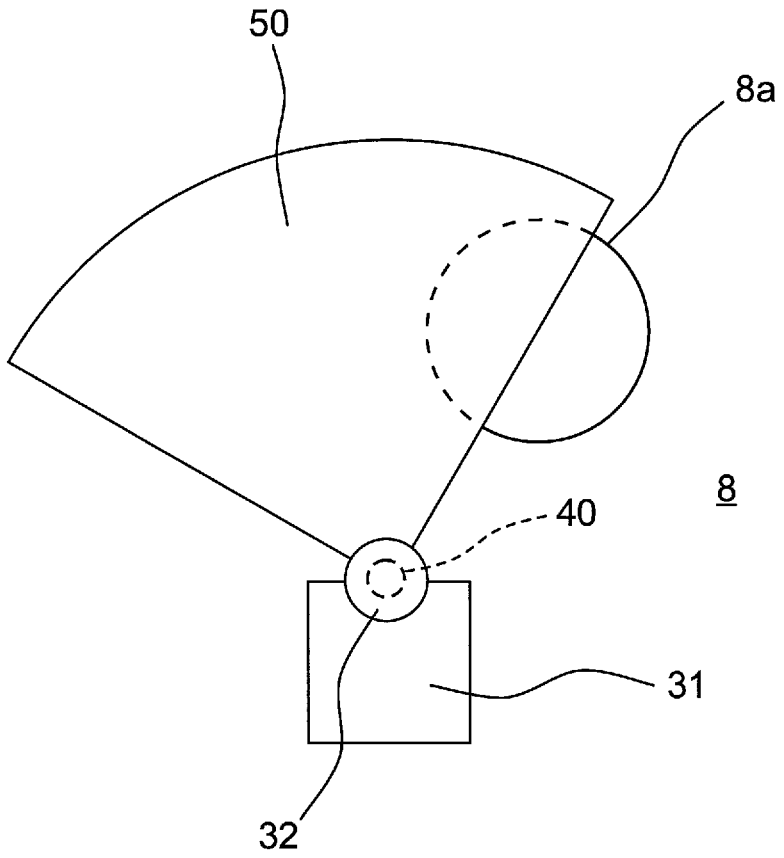
FIG. 9 is a schematic view for explaining opening/closing operations of the air supply damper in the heat cooker.
Figure 10:
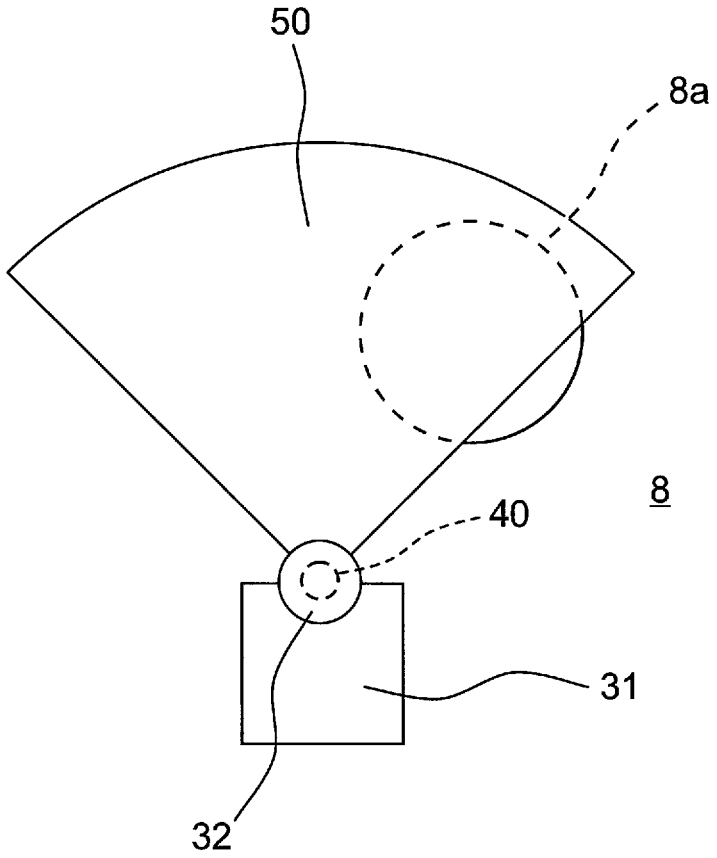
FIG. 10 is a schematic view for explaining opening/closing operations of the air supply damper in the heat cooker.
Figure 11:
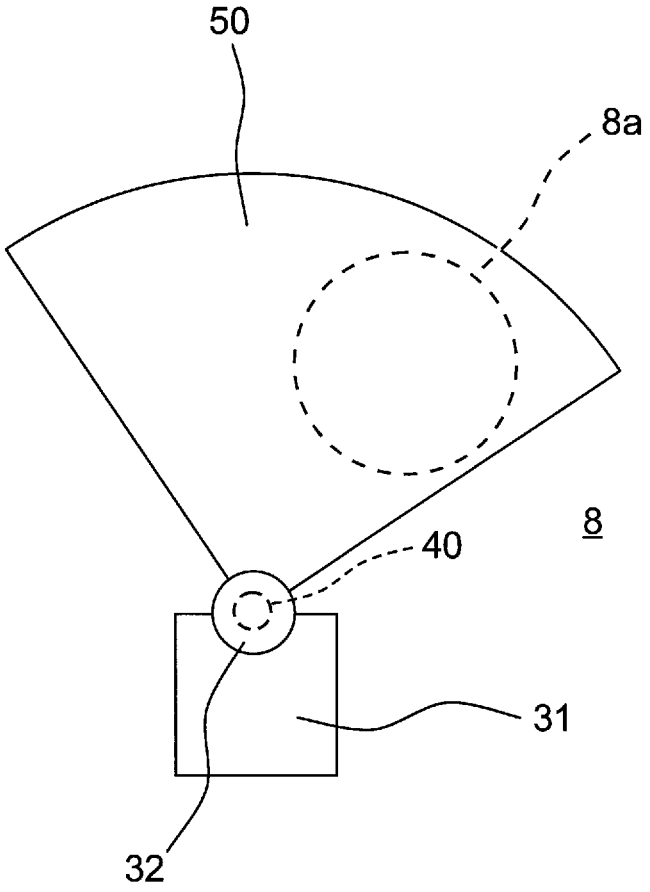
FIG. 11 is a schematic view for explaining opening/closing operations of the air supply damper in the heat cooker.

The air supply damper 50, as shown in FIG. 7, is generally sectoral-shaped as viewed sideways and swingable about a pivot 40 in an arrow direction in the figure. The air-supply-damper encoder 32 detects a swing angle of the air supply damper 50, and outputs the detected swing angle to the control unit 200. Based on a signal from the air-supply-damper encoder 32, the control unit 200 controls the air-supply-damper motor 31. As a result of this, as shown in FIG. 11, the air supply opening 8*a* is fully closed by the air supply damper 50, so that air supply into the heating compartment 8 can be stopped. Further, the control unit 200 is enabled to control the air-supply-damper motor 31 so that the opening area of the air supply opening 8*a* is set to about ¾ of a full-open one (state of FIG. 7) as shown in FIG. 8, or that the opening area of the air supply opening 8*a* is set to about ½ of the full-open one as shown in FIG. 9, or that the opening area of the air supply opening 8*a* is set to about ¼ of the full-open one as shown in FIG. 10. Thus, the control unit 200 is enabled to control the swing angle of the air supply damper 50 to an arbitrary angle so that the opening area of the air supply opening 8*a* can be arbitrarily changed. That is, a ratio of air flowing into the heating compartment 8 via the plurality of air supply openings 8*a* relative to air sucked into the casing 1 via the plurality of air suction openings 17 can be arbitrarily changed. In addition, the air supply openings 8*a*, the air-supply-damper motor 31, the air-supply-damper encoder 32, the pivot 40 and the air supply damper 50 constitute an example of a variable air supply opening according to the invention.

Hereinbelow, opening/closing control of the air supply damper 50 by the control unit 200 will be described with reference to flowcharts of FIGS. 12A and 12B. The opening/closing control is started upon a start of heat cooking. At the start time, the control unit 200 drives the cooling fan 16.

Figure 12A:
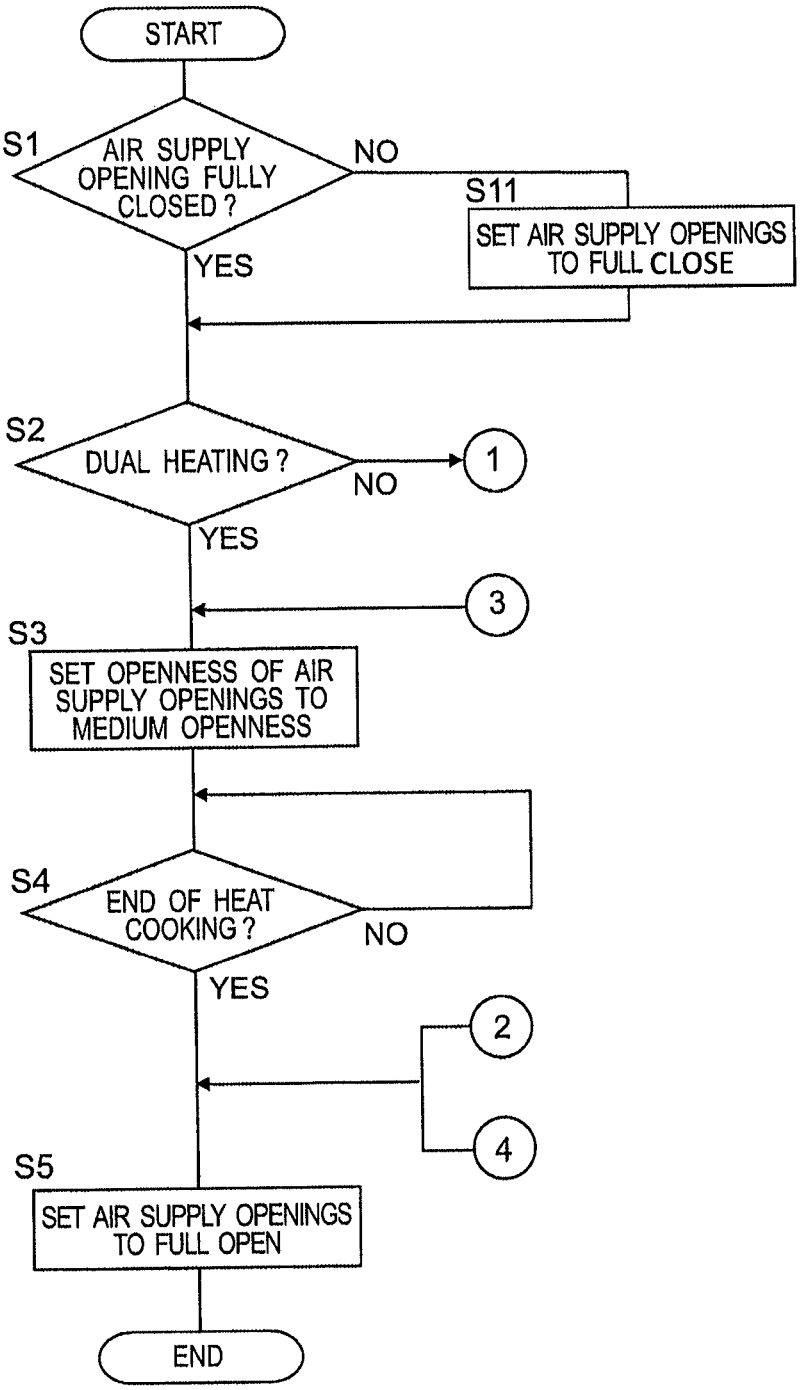
FIG. 12A is a flowchart for explaining opening/closing control of the air supply damper in the heat cooker.

With the opening/closing control started, first at step S1 of FIG. 12A, it is decided whether or not all the air supply openings 8*a* have been closed by the air supply damper 50. If it is decided at step S1 that all the air supply openings 8*a* have been closed by the air supply damper 50, the processing flow goes to next step S2. On the other hand, if it is decided at step S1 that all the air supply openings 8*a* have not been closed by the air supply damper 50, then the processing flow goes to step S11, where the air supply damper 50 is swung so that all the air supply openings 8*a* are closed, followed by move to next step S2. In addition, that the air supply openings 8*a* are fully closed by the air supply damper 50 means that all the air supply openings 8*a* are covered by the air supply damper 50.

Next, at step S2, it is decided whether or not dual heating is exerted. If it is decided at step S2 that dual heating is exerted, then the processing flow goes to next step S3. On the other hand, if it is decided at step S2 that dual heating is not exerted, the processing flow goes to step S21 of FIG. 12B. It is noted here that then term, dual heating, means turning on the heater 26 and the magnetron 51 simultaneously to heat the heating object 23. In addition, description for the case of move to step S21 will be given after the description of steps S3 to S5.

Next, at step S3 of FIG. 12A, the air supply damper 50 is swung to close part of the plurality of air supply openings 8*a* so that the openness of the air supply opening 8*a* is set to a medium openness. It is noted here that the term, medium openness, refers to an openness within a range of 20% to 60% (e.g., 20%). Also, the state that the openness of the air supply openings 8*a* is set to a medium openness refers to a state that air supply via the air supply openings 8*a* into the heating compartment 8 is enabled, where an air supply amount in this state is less than an air supply amount resulting when the openness of the air supply openings 8*a* is 100%. Also, the state that the openness of the air supply openings 8*a* is 100% corresponds to a state that none of the plurality of air supply openings 8*a* are covered by the air supply damper 50 so that a large amount of air supply via the air supply openings 8*a* into the heating compartment 8 is enabled. Further, the state that the openness of the air supply opening 8*a* is 0% corresponds to a state that all the plurality of air supply openings 8*a* are covered by the air supply damper 50 so that air supply via the air supply openings 8*a* into the heating compartment 8 is disabled. In addition, the medium openness is an example of a target openness of the present invention.

Next, at step S4 of FIG. 12A, it is decided by using an output signal of the timer 201 whether or not heat cooking of the heating object 23 has been ended. If it is decided at step S4 that the heat cooking of the heating object 23 has not been ended, then step S4 is performed once again. On the other hand, if it is decided at step S4 that the heat cooking of the heating object 23 has been ended, then the processing flow goes to next step S5.

Next, at step S5, the air supply damper 50 is swung to make all the air supply openings 8*a* opened, where the opening/closing control is ended.

Figure 12B:
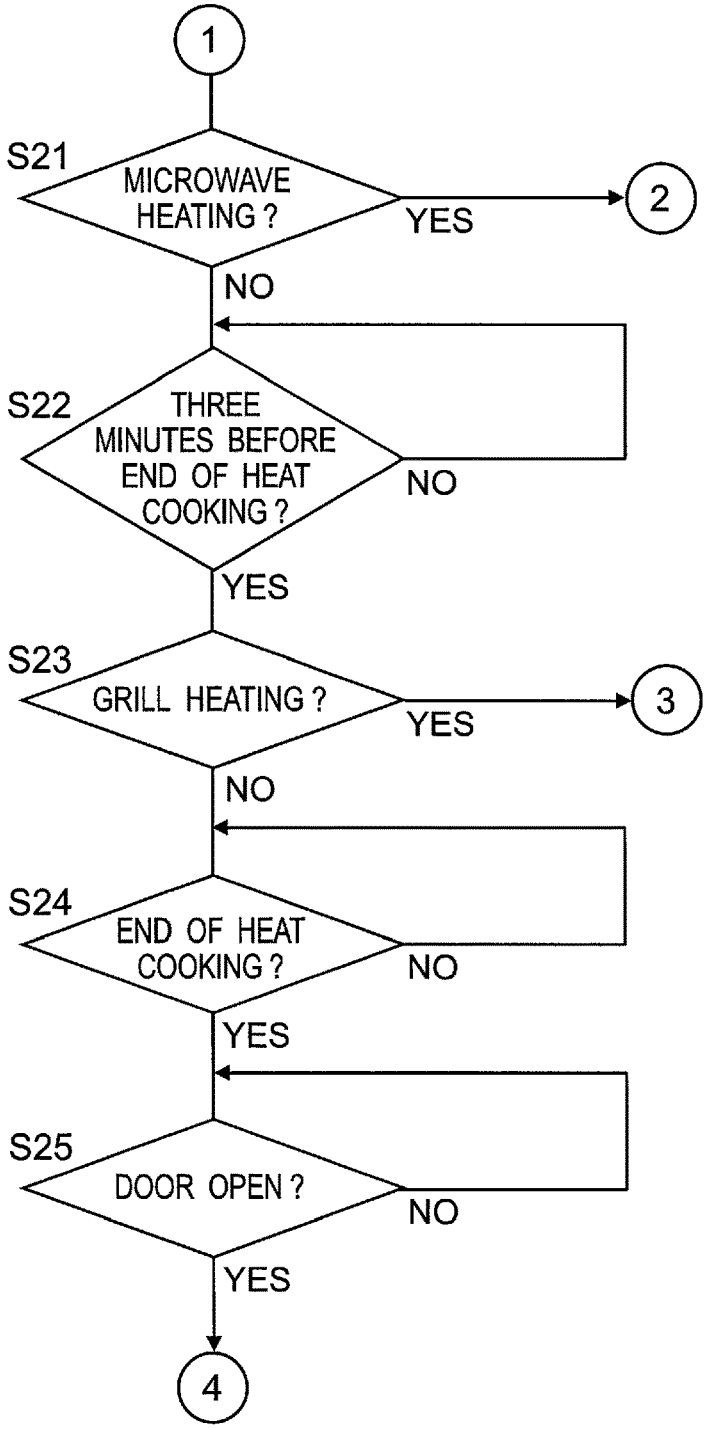
FIG. 12B is a flowchart for explaining opening/closing control of the air supply damper in the heat cooker.

In a case of move from step S2 to step S21 of FIG. 12B, it is decided whether or not microwave heating is exerted. If it is decided at step S21 that microwave heating is not exerted, then the processing flow goes to next step S22. On the other hand, if it is decided at step S21 that microwave heating is exerted, then the processing flow goes to step S5 of FIG. 12A. It is noted here that the term, microwave heating, refers to heating the heating object 23 with the magnetron 51 alone turned on out of the heater 26 and the magnetron 51.

Next, at step S22 of FIG. 12B, it is decided by using an output signal of the timer 201 whether or not the timer counts three minutes before an end of heat cooking. If it is decided at step S22 that the timer does not count three minutes before an end of heat cooking, then the step S22 is performed once again. On the other hand, if it is decided at step S22 that the timer counts three minutes before an end of heat cooking, then the processing flow goes to next step S23.

Next, at step S23, it is decided whether or not grill heating is exerted. If it is decided at step S23 that grill heating is not exerted, the processing flow goes to next step S24. On the other hand, if it is decided at step S23 that grill heating is exerted, then the processing flow goes to step S3 of FIG. 12A. It is noted here that the term, grill heating, refers to heating the heating object 23 with the heater 26 alone turned on out of the heater 26 and the magnetron 51. In addition, among the cases of move to next step S24 is, for example, a case of steam heating in which steam is fed from the steam generation unit 13 to the heating compartment 8 to do steaming of the heating object 23.

Next, at step S24, it is decided by using an output signal of the timer 201 whether or not heat cooking of the heating object 23 has been ended. If it is decided at step S24 that the heat cooking of the heating object 23 has not been ended, then the step S24 is performed once again. On the other hand, if it is decided at step S24 that the heat cooking of the heating object 23 has been ended, then the processing flow goes to next step S25.

Next, at step S25, it is decided by using a detection signal from the door opening/closing sensor 36 whether or not the handle-attached door 2 has been opened. If it is decided at step S25 that the handle-attached door 2 has not been opened, then the step S25 is performed once again. On the other hand, if it is decided at step S25 that the handle-attached door 2 has been opened, then the processing flow goes to step S5 of FIG. 12A.

As shown above, during the progress of dual heating, opening/closing operations of the air supply damper 50 are controlled so that the openness of the air supply openings 8*a* comes to an medium openness, allowing a proper amount of outside air to be supplied through the air supply openings 8*a* into the heating compartment 8. As a result of this, smoke in the heating compartment 8 can be gradually discharged out of the casing 1. Thus, during the progress of dual heating, smoke discharged from within the heating compartment 8 out of the casing 1 can be kept unnoticeable.

Further, during the progress of dual heating, since the smoke in the heating compartment 8 is discharged out of the casing 1, filling of smoke in the heating compartment 8 can be prevented at an end of the dual heating. Therefore, even after an end of the dual heating, smoke discharged from within the heating compartment 8 out of the casing 1 can be kept unnoticeable.

Then, during the progress of dual heating, by virtue of the openness of the air supply openings 8*a* set to a medium openness, no large amount of outside air flows through the air supply openings 8*a* into the heating compartment 8, so that discharge of high-temperature air in the heating compartment 8 out of the casing 1 is prevented. Thus, since declines of the temperature-increasing speed in the heating compartment 8 can be suppressed, the time required for dual heating can be shortened.

Moreover, since the openness of the air supply openings 8*a* is set to a medium openness at a time point three minutes before an end of grill heating, a proper quantity of air supply into the heating compartment 8 is exerted during the period from the time three minutes before an end of grill heating until the end, so that the smoke in the heating compartment 8 can be gradually pushed out of the casing 1. Therefore, during the period from the time three minutes before an end of grill heating until the end, the smoke discharged from within the heating compartment out of the casing 1 can be kept unnoticeable.

Also, since the openness of the air supply openings 8*a* is 0% before the time point three minutes before an end of grill heating, inside of the heating compartment 8 can be maintained at high temperatures. Moreover, when the time becomes three minutes before an end of grill heating, opening/closing operations of the air supply damper 50 are controlled so that the openness of the air supply openings 8*a* is set to a medium openness, allowing a proper quantity of outside air to be supplied through the air supply openings 8*a* into the heating compartment 8. As a result of this, smoke in the heating compartment 8 can be gradually discharged out of the casing 1. Thus, after the time has become three minutes before an end of grill heating, smoke discharged from within the heating compartment 8 out of the casing 1 can be kept unnoticeable.

Further, after the time has become three minutes before an end of grill heating, discharging of smoke in the heating compartment 8 is started, so that filling of smoke in the heating compartment 8 can be prevented at an end of the grill heating. Therefore, even after an end of the grill heating, smoke discharged from within the heating compartment 8 out of the casing 1 can be kept unnoticeable.

Then, during the period from the time three minutes before an end of grill heating until the end, since the openness of the air supply openings 8*a* is set to a medium openness, no large amount of outside air flows through the air supply openings 8*a* into the heating compartment 8, so that discharge of high-temperature air in the heating compartment 8 out of the casing 1 is prevented. Thus, declines of the temperature-increasing speed in the heating compartment 8 is prevented and, as a result, the time required for grill heating can be shortened.

Smoke, steam and the like in the heating compartment 8 are discharged on the front face side of the casing 1 via the exhaust opening 8*b*, the exhaust tube 18 and the exhaust duct 100. Thus, even if a wall surface is present near the rear face of the casing 1, there can be prevented contaminations of the wall surface or occurrence of mold.

Moreover, since the rear face of the casing 1 may be placed close to the wall surface, there is a high degree of freedom for placement of the casing 1, giving a good convenience for use.

During the opening/closing control, electrical components such as the magnetron 51 and the power transformer 52 are cooled by the gas blown into the casing 1 by the cooling fan 16, so that thermal destruction of the electrical components can be prevented.

The gas that has flowed through the electrical component chamber 9 and that has not flowed into the air supply openings 8*a* is finally mixed with exhaust gas discharged from the exhaust opening 8*b*, and therefore contributes to dilution of the exhaust gas. Thus, the dilution effect for the exhaust gas can be enhanced.

Also, since all of the gas flowing through the electrical component chamber 9 does not enter into the heating compartment 8, heat within the heating compartment 8 is prevented from undergoing more than necessary loss.

Further, since steam by the steam generation unit 13 is supplied into the heating compartment 8, heat cooking of the heating object 23 can be fulfilled while moisture is being given to the heating object 23.

The heat cooker of the above-described construction is enabled to fulfill heating with superheated steam in addition to the above-described dual heating, microwave heating, grill heating, and steam heating.

For execution of the heating with superheated steam, a supply water tank with a necessary amount of water contained therein is accommodated in the tank accommodating part 15, and then the operation panel 3 is operated. Then, the heater 26 located upward in the heating compartment 8 is turned on while the water supply pump 35 is driven, so that water in the supply water tank is supplied to the steam generation unit 13. Then, the steam generation heater 24 heats the water derived from the supply water tank, causing steam to be generated. The steam generated in the steam generation unit 13 is blown into the heating compartment 8 and heated by the heater 26 in the heating compartment 8, forming a superheated steam of 100° C. or higher. As a result, the heating object 23 in the heating compartment 8 is heat-cooked by radiant heat from the heater 26 located upward in the heating compartment 8 and the superheated steam of 100° C. or higher. In this process, superheated steam supplied and sticking to the heating object 23 is condensed at surfaces of the heating object 23 so as to give a large amount of condensed latent heat to the heating object 23, thus allowing heat to be transferred to the heating object 23 efficiently.

In the above-described embodiment, the openness of the air supply openings 8*a* is set to 20% during the dual heating. Alternatively, the openness of the air supply openings 8*a* may also be set so as to increase according to time elapse within a range of 20% to 60% during the dual heating. For example, the openness of the air supply openings 8*a* may be set to 20% during a period from a start of dual heating until a time three minutes before an end of the dual heating, set to 30% during a period from the time three minutes before the end of the dual heating until a time two minutes before the end of the dual heating, set to 40% during a period from the time two minutes before the end of the dual heating until a time one minute before the end of the dual heating, and set to 60% during a period from the time one minute before the end of the dual heating until the end of the dual heating.

In the embodiment, an openness of the air supply openings 8*a* during dual heating, and an openness of the air supply openings 8*a* during a period after a time three minutes before an end of grill heating, are set to 20% equally for both cases. However, the openness of the air supply openings 8*a* during dual heating and the openness of the air supply openings 8*a* during a period after the time three minutes before an end of grill heating, may be set to mutually different opennesses. For example, it is allowable that the openness of the air supply openings 8*a* during dual heating is set to 20% while the openness of the air supply openings 8*a* during a period after the time three minutes before an end of grill heating is set to 30%.

In the embodiment, the openness of the air supply openings 8*a* is set to 20% during a period from the time three minutes before an end of grill heating until the end of grill heating. However, the openness of the air supply openings 8*a* may be set so as to increase according to time elapse within a range of 20% to 60% during a period from the time three minutes before an end of grill heating until the end of grill heating. For example, the openness of the air supply openings 8*a* may be set to 30% during a period from a time three minutes before an end of grill heating until a time two minutes before the end of grill heating, set to 40% during a period from the time two minutes before the end of grill heating until a time one minute before the end of grill heating, and set to 60% during a period from the time one minute before the end of grill heating until the end of grill heating.

In the above and other embodiments, it is allowable that a first-half heating of the heating object 23 is dual heating and a second-half heating of the heating object 23 is grill heating. In this case, the openness of the air supply openings 8*a* during the first-half dual heating may be set to 20%. On the other hand, in the second-half grill heating, the openness of the air supply openings 8*a* may be set to 20% during a period from a start of the grill heating until a time three minutes before an end of the grill heating, set to 30% during a period from the time three minutes before the end of grill heating until a time two minutes before the end of grill heating, set to 40% during a period from the time two minutes before the end of grill heating until a time one minute before the end of grill heating, and set to 60% during a period from the time one minute before the end of grill heating until the end of the grill heating.

Figure 13:
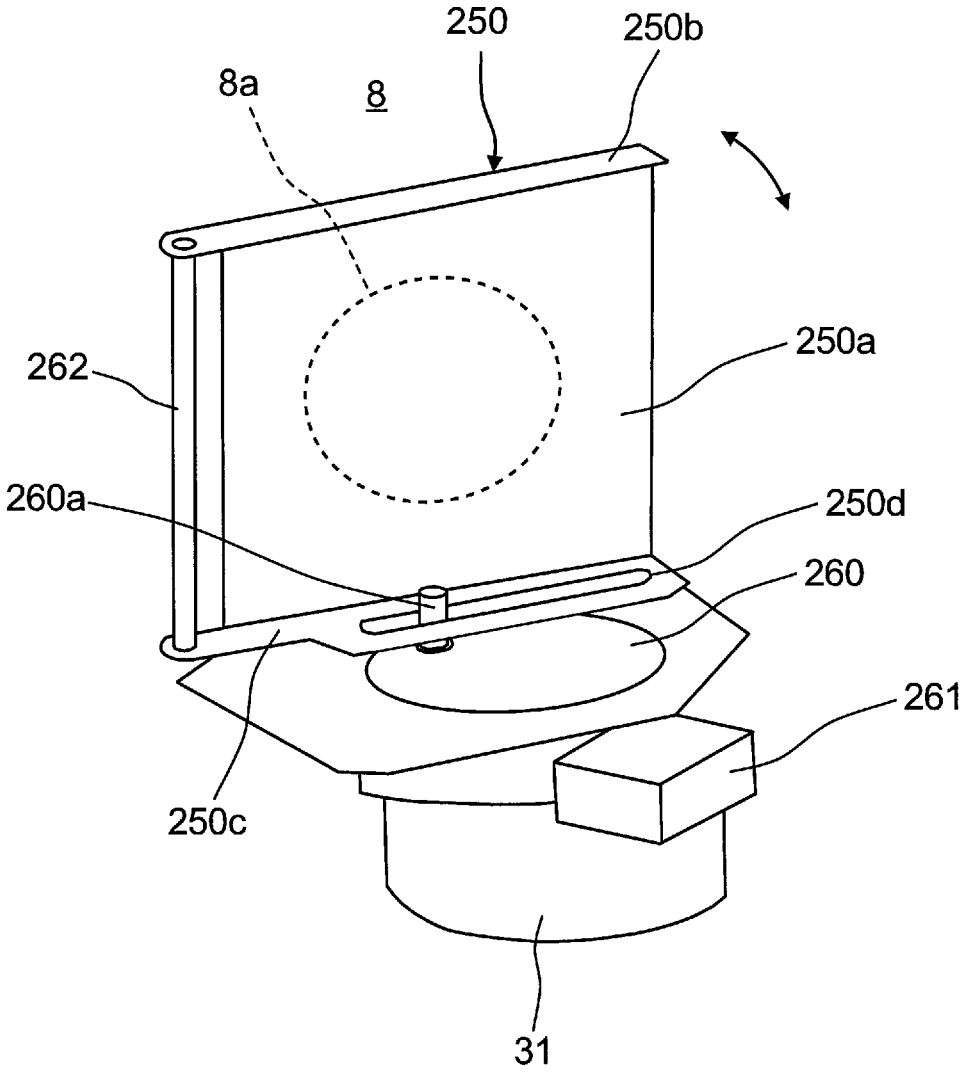
FIG. 13 is a perspective view for explaining a modification of the air supply damper.

In the embodiment, the air supply openings 8*a* are opened and closed by the swing type air supply damper 50 shown in FIGS. 7 to 11. Alternatively, as shown in FIG. 13, the air supply openings 8*a* may be opened and closed by a turning type air supply damper 250.

A case with use of the air supply damper 250 is described below in more detail. The air supply damper 250 includes a body portion 250*a*, an upper flange portion 250*b* provided at an upper end portion of the body portion 250*a*, and a lower flange portion 250*c* provided at a lower end portion of the body portion 250*a*, and the air supply damper 250 is turnable in a direction of a thin arrow in FIG. 13 about a stationary pivot 262. Each one end portion of the upper flange portion 250*b* and the lower flange portion 250*c* is coupled to the turning pivot 262. A cam groove 250*d*, which is an linear elongate hole, is provided in the lower flange portion 250*c*. This cam groove 250*d* extends in a direction vertical to the turning pivot 262.

Placed below the air supply damper 250 is an air-supply-damper motor 31 for turning a damper cam 260. A turning angle of the damper cam 260 can be detected by a turning-angle detection switch 261. Also, the damper cam 260 has a cam shaft 260*a* on its upper end face, and the cam shaft 260*a* is inserted into the cam groove 250*d*. In addition, the air supply opening 8*a*, the air-supply-damper motor 31, the air supply damper 250, the damper cam 260, the turning-angle detection switch 261 and the stationary pivot 262 constitute an example of the variable air supply opening according to the invention.

When the body portion 250*a* of the air supply damper 250 as shown above is put into close contact with a peripheral edge portion of the air supply opening 8*a*, the air supply opening 8*a* is perfectly closed. As a result, outside air from the cooling fan 16 is inhibited from passing through the air supply opening 8*a*. That is, air supply into the heating compartment 8 is blocked.

Figure 14:
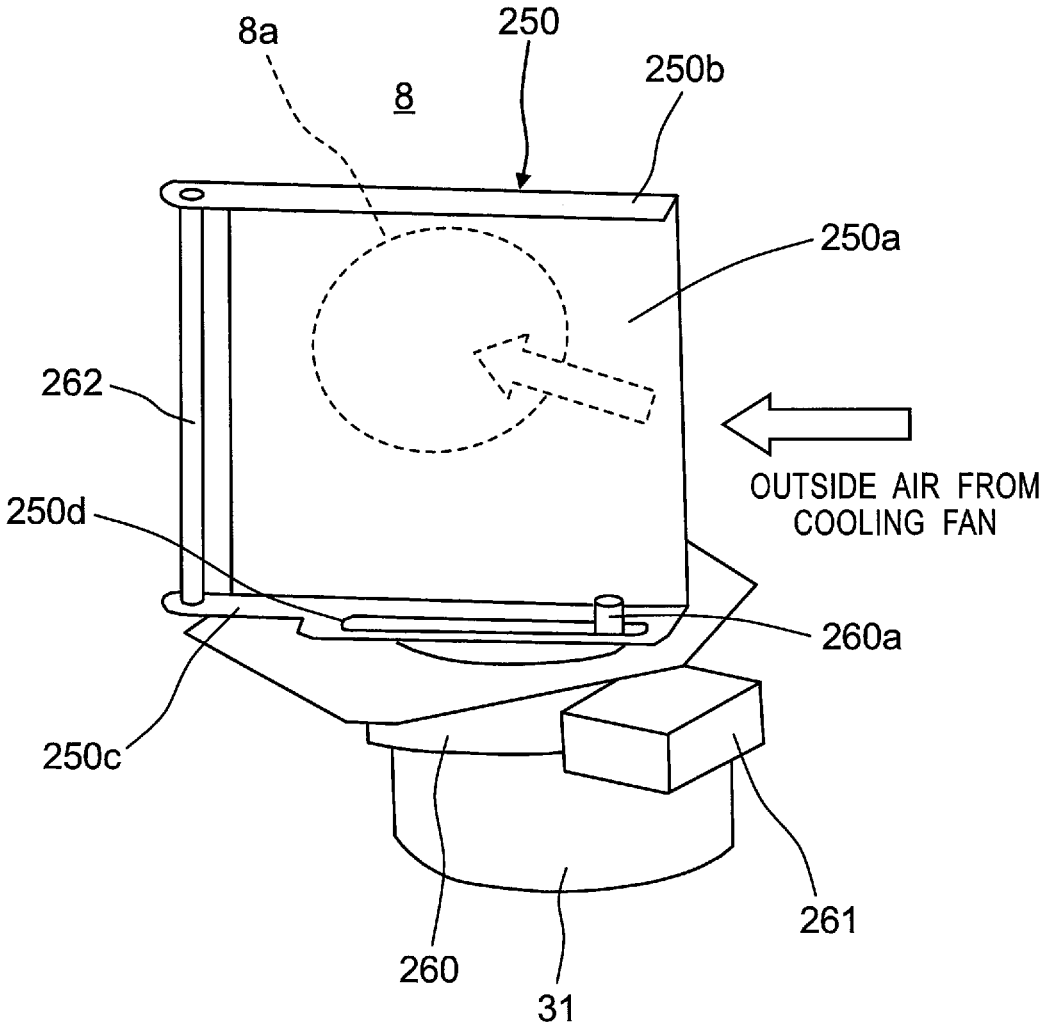
FIG. 14 is a perspective view for explaining a modification of the air supply damper.

Then, as the damper cam 260 is driven into rotation by the air-supply-damper motor 31, the cam shaft 260*a* is moved within the cam groove 250*d* as shown in FIG. 14, so that the air supply damper 250 is turned in such a direction as to go apart from the air supply opening 8*a*. As a result, the openness of the air supply opening 8*a* becomes a full one, so that outside air from the cooling fan 16 is allowed to pass through the air supply opening 8*a* as shown by a thick arrow in FIG. 14.

In a case where the openness of the air supply opening 8*a* is set to a medium openness by the air supply damper 250, the turning angle of the air supply damper 250 is set larger than that of FIG. 13 and smaller than that of FIG. 14. As a result, the air supply amount into the heating compartment 8 via the air supply opening 8*a* can be made smaller than an air supply amount for a 100% openness of the air supply opening 8*a* without changing an air flow amount of the cooling fan 16, thus making it possible to achieve a proper degree of air supply into the heating compartment 8. It is noted that the term, medium openness, refers to an openness within a range of 20% to 60% (e.g., 20%). Also, the state that the openness of the air supply opening 8*a* is set to 0% refers to a state that air supply into the heating compartment 8 via the air supply opening 8*a* is disabled, corresponding to a state that the turning angle of the air supply damper 250 is 0°. Also, the state that the openness of the air supply opening 8*a* is set to 100% refers to a state that air supply into the heating compartment 8 via the air supply opening 8*a* is enabled, corresponding to a state that the turning angle of the air supply damper 250 is 50°. In addition, the medium openness is an example of the target openness according to the invention.

In other words, when the openness of the air supply opening 8*a* is set to a medium openness, an angle formed by an air-supply-opening-8*a*-side side face of the heating compartment 8 and the air supply damper 250 is larger than that of the state of FIG. 13 and smaller than that of the state of FIG. 14.

In the case where the air supply opening 8*a* is opened and closed by the air supply damper 250, opening/closing operations similar to those of the above-described embodiment or its modifications may be fulfilled by the air supply damper 250.

It is noted that the plurality of air supply openings 8*a* are regarded and depicted as one through hole also in FIGS. 13 and 14 for the same reasons as in FIGS. 7 to 11.

In the above embodiment, control for setting the openness of the air supply openings 8*a* to a medium openness is started at a time point three minutes before an end of grill heating. However, it is also allowed, for example, that control for setting the openness of the air supply openings 8*a* to a medium openness is started at a time point five minutes or four minutes before an end of grill heating. Further, such control may be done for heating other than grill heating.

In the above embodiment and its modifications, the medium openness of the air supply openings 8*a* may be set to one larger than 0% and less than 20% or to one larger than 60% and less than 100%.

In the case where the medium openness of the air supply openings 8*a* is set to one larger than 0% and less than 20%, the smoke exhausting effect in the heating compartment 8 is lowered but the temperature-decrease suppression effect in the heating compartment 8 is enhanced, as compared with the case where the medium openness of the air supply openings 8*a* is set to one within a range of 20% to 60%. In this connection, even if the smoke exhausting effect in the heating compartment 8 is lowered, smoke discharged from within the heating compartment 8 out of the casing 1 is prevented from becoming noticeable.

In the case where the medium openness of the air supply openings 8*a* is set to one larger than 60% and less than 100%, the temperature-decrease suppression effect in the heating compartment 8 is lowered but the smoke exhausting effect in the heating compartment 8 is enhanced, as compared with the case where the medium openness of the air supply openings 8*a* is set to one within a range of 20% to 60%. In this connection, even if the temperature-decrease suppression effect in the heating compartment 8 is lowered, elongation of time for heat cooking of the heating object 23 is prevented.

In the case where the medium openness of the air supply openings 8*a* is set to one within a range of 20% to 60%, both the temperature-decrease suppression effect in the heating compartment 8 and the smoke exhausting effect in the heating compartment 8 can be enhanced with good balance, preferably.

Also in the above embodiment, a plurality of air supply openings 8*a* are provided in the heating compartment 8. Alternatively, one air supply opening 8*a* may be provided in the heating compartment 8.

Also in the above embodiment, exhaust gas from within the heating compartment 8 is discharged via the exhaust tube 18 and the exhaust duct 100 into the dew receiving container 4. Alternatively, with the exhaust duct 100 eliminated, exhaust gas from within the heating compartment 8 may be discharged directly from the exhaust tube 18 into the dew receiving container 4.

Also in the above embodiment, the opening 8*c* of the heating compartment 8 is opened and closed by the handle-attached door 2 that turns laterally relative to the casing 1. Alternatively, the opening 8*c* of the heating compartment 8 may be opened and closed by a door that slides back and forth relative to the casing 1. That is, the door provided in the heat cooker of the invention may be either turning type or sliding type.

Although mixed heating is not performed in the above embodiment, yet mixed heating may be done. In a case where the mixed heating is executed, the openness of the air supply openings 8*a* may be set to a medium openness during the mixed heating. It is noted that the term, mixed heating, refers to heating of the heating object 23 by turning on the heater 26 and the magnetron 51 alternately.

The heat cooker according to the invention is exemplified by not only microwave ovens with use of superheated steam but also ovens with use of superheated steam, microwave ovens without use of superheated steam, ovens without use of superheated steam, and the like.

According to the heat cooker of the invention, there are provided microwave ovens and the like capable of fulfilling healthy cooking with use of superheated steam or saturated steam. For example, in the heat cooker of the invention, superheated steam or saturated steam of 100° C. or higher temperatures is fed to surfaces of food, and the superheated steam or saturated steam sticking to the surfaces of the food is condensed to impart a large amount of condensed latent heat to the food, thus allowing heat to be transferred to the food efficiently. Also, condensed water sticks to food surfaces, and salinity and oil contents drip together with the condensed water, so that salinity and oil contents in the food can be reduced. Further, the heating chamber is filled with superheated steam or saturated steam so as to come to a low-oxygen state, so that cooking with oxidation of food suppressed is enabled. It is noted here that the term, low-oxygen state, refers to a state that the volume percent of oxygen in the heating chamber is 10% or lower (e.g., 1.0 to 0.5%).

Concrete embodiments of the present invention have been described hereinabove. However, the invention is not limited to the above-described embodiments, and may be changed and modified in various ways within the scope of the invention.

REFERENCE SIGNS LIST

1 casing
2 handle-attached door
3 operation panel
4 dew receiving container
8 heating compartment
8*a* air supply opening
8*b* exhaust opening
8*c* opening
9 electrical component chamber
10 air suction space
11, 11 heat shielding plate
13 steam generation unit
15 tank accommodating part
16 cooling fan
17 air suction opening
18 exhaust tube
21 partitioning wall
23 heating object
24 steam generation heater
26 heater
30 cooling-fan motor
31 air-supply-damper motor
32 air-supply-damper encoder
33 interior temperature sensor
35 water supply pump
36 door opening/closing sensor
50, 250 air supply damper
51 magnetron
52 power transformer
200 control unit
201 timer

The invention claimed is:

1. A heat cooker comprising:
a casing;
a heating compartment provided in the casing and having an opening on a front face side to accommodate therein a heating object, which is an item to be heated;
a door for opening and closing the opening of the heating compartment;
a heater to be used for grill heating of the heating object;
a magnetron that generates microwave to heat the heating object;
a steam generator that generates steam to be provided to the heating compartment;
an air supply fan, provided in the casing, for sucking outside air outside the casing and blowing the outside air into the casing;
an air supply passage for allowing the outside air, which is blown out by the air supply fan, to flow there through inside the casing;
a variable-type air supply opening provided in the heating compartment and enabled to bring the outside air within the air supply passage into the heating compartment at an arbitrary ratio wherein the variable type air supply opening includes,
an air supply opening,
an air supply damper having a cam groove formed thereon and pivoting on a pivot,
an air supply damper motor selectively driving a damper cam,
the damper cam including
the cam groove provided on the air supply damper and having an relieved area which extends generally vertically with respect to the pivot, and
a cam shaft inserted into the cam groove and eccentric on the damper cam, the cam shaft rotated about the pivot by the air supply damper motor;
an exhaust opening provided in the heating compartment to discharge smoke within the heating compartment out of the heating compartment;
an exhaust passage for guiding the smoke to outside of the casing; and
a control controlling operation of the variable-type air supply opening, wherein
the control is programmed to:
determine whether the heating object is being heated by the heater and the magnetron, simultaneously, or only by the heater, and
control the variable-type air supply opening so that an openness of the air supply opening becomes a predetermined target openness when only the heater is operating or the heater and the magnetron are operating simultaneously.

2. The heat cooker as claimed in claim 1, wherein the control unit is further programmed to:
upon an end of the heat cooking, control operation of the variable-type air supply opening so that the openness of the air supply opening becomes larger than the target openness.

3. The heat cooker as claimed in claim 1, wherein
the control unit controls operation of the variable-type air supply opening so that the openness of the air supply opening becomes the target openness at a time point which is a preset time duration before an end of heat cooking of the heating object.

4. The heat cooker as claimed in claim 1, wherein
gas blown out into the casing by the air supply fan cools heat generating components in the casing.

5. The heat cooker as claimed in claim 1, wherein
gas that has flowed through the air supply passage and that has not flowed into the variable-type air supply opening is finally mixed with exhaust gas discharged from the exhaust opening.

6. The heat cooker as claimed in claim 1, wherein
the exhaust passage guides smoke, which has come out of the heating compartment from the exhaust opening, toward a front face side of the casing.

7. The heat cooker as claimed in claim 1, further comprising:
a steam generation unit for generating steam to be supplied into the heating compartment.

8. The heat cooker of claim 1 wherein the target openness is within a range of 20% to 60%.

9. The heat cooker of claim 1 wherein the air supply damper motor has an axis of rotation, said cam shaft being offset from the axis of rotation of said air supply damper motor so as to travel in an arc when said air supply damper motor is turned around the axis of rotation.

* * * * *